US012507754B2

(12) United States Patent
Bonanni, Sr.

(10) Patent No.: US 12,507,754 B2
(45) Date of Patent: Dec. 30, 2025

(54) PADDED FACEMASK SHIELD

(71) Applicant: Proactive Solutions Management, LLC, Pittsford, NY (US)

(72) Inventor: Andrew James Bonanni, Sr., Pittsford, NY (US)

(73) Assignee: Proactive Solutions Management, LLC, Greensboro, NC (US)

( * ) Notice: Subject to any disclaimer, the term of this patent is extended or adjusted under 35 U.S.C. 154(b) by 252 days.

(21) Appl. No.: 17/219,004

(22) Filed: Mar. 31, 2021

(65) Prior Publication Data

US 2021/0315309 A1 Oct. 14, 2021

Related U.S. Application Data

(60) Provisional application No. 63/008,179, filed on Apr. 10, 2020.

(51) Int. Cl.
*A42B 3/20* (2006.01)
*A42B 3/04* (2006.01)
*A42B 3/18* (2006.01)

(52) U.S. Cl.
CPC ..... *A42B 3/20* (2013.01); *A42B 3/04* (2013.01); *A42B 3/18* (2013.01)

(58) Field of Classification Search
CPC .. A42B 3/20; A42B 3/205; A42B 3/04; A42B 3/18; A42B 3/288; A63B 71/10; A63B 2071/105
See application file for complete search history.

(56) References Cited

U.S. PATENT DOCUMENTS

| | | | | | |
|---|---|---|---|---|---|
| 3,041,623 | A * | 7/1962 | Glahe | A63B 71/10 | 2/9 |
| 4,736,466 | A * | 4/1988 | Kallstrom | A63B 71/10 | 2/427 |
| 5,216,758 | A * | 6/1993 | Rabquer | A42B 3/20 | 2/9 |
| 5,893,174 | A * | 4/1999 | Primeau | A42B 3/145 | 2/9 |
| 6,338,340 | B1 * | 1/2002 | Finch | A62B 23/025 | 128/206.28 |
| 6,976,272 | B2 * | 12/2005 | Krzysik, Jr | A42B 3/20 | 2/9 |
| 9,613,611 | B2 | 4/2017 | Ozluturk | | |
| 9,770,642 | B2 | 9/2017 | Wyner et al. | | |
| 10,736,366 | B2 | 8/2020 | Bell | | |
| D947,462 | S * | 3/2022 | Berg | D29/122 | |
| 2008/0066208 | A1 * | 3/2008 | Tagliente | A42B 3/20 | 2/9 |
| 2008/0127400 | A1 * | 6/2008 | Dupuis | A42B 3/185 | 2/9 |

(Continued)

*Primary Examiner* — Khoa D Huynh
*Assistant Examiner* — Giao QT Hoang
(74) *Attorney, Agent, or Firm* — NK Patent Law

(57) ABSTRACT

A padded facemask shield assembly is provided for a protective helmet having a facemask with an inboard surface and an outboard surface. The padded facemask shield assembly has a frame, including an elastic frame, at least one resilient pad connected to the frame, and a coupler connected to at least one of the frame and the at least one resilient pad, wherein the coupler is configured to releasably engage the facemask and locate the frame and the at least one resilient pad on the outboard surface of the facemask.

19 Claims, 5 Drawing Sheets

(56) References Cited

U.S. PATENT DOCUMENTS

| | | | | |
|---|---|---|---|---|
| 2009/0014005 | A1* | 1/2009 | MacKinnon | A42B 3/20 2/171.3 |
| 2012/0066813 | A1* | 3/2012 | Singh | A42B 3/20 2/173 |
| 2015/0026858 | A1* | 1/2015 | Ross | A42B 3/18 2/2.5 |
| 2015/0033455 | A1* | 2/2015 | Beauchamp | A42B 3/127 2/421 |
| 2018/0035729 | A1* | 2/2018 | Pearson | A63B 71/10 |
| 2018/0070668 | A1* | 3/2018 | Stephens | A42B 3/288 |
| 2018/0249771 | A1* | 9/2018 | Jackson | A41D 13/1184 |

* cited by examiner

Fig. 4
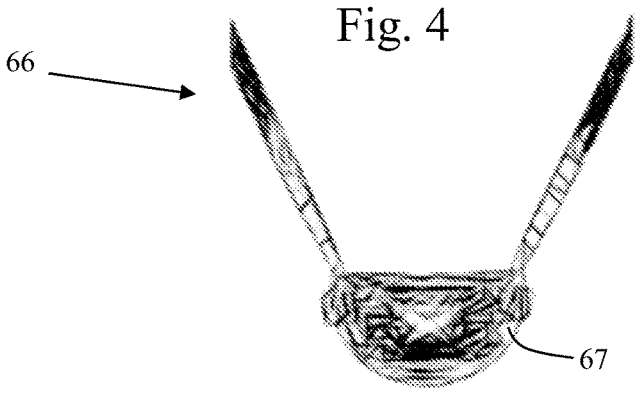
Fig. 5
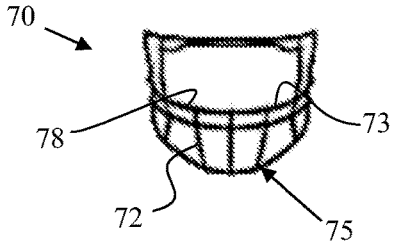
Fig. 6
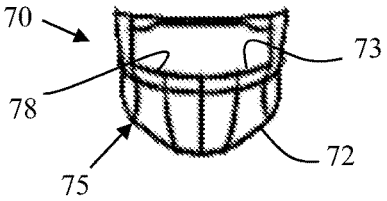
Fig. 7
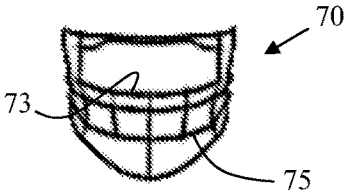
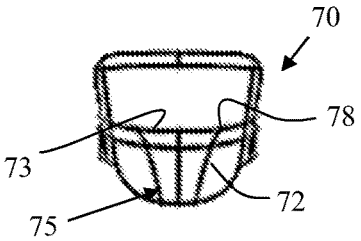
Fig. 8
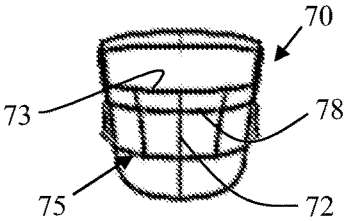
Fig. 9
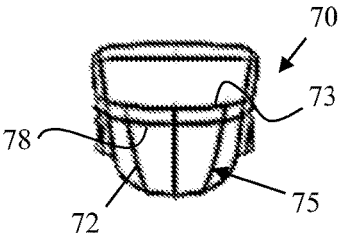
Fig. 10
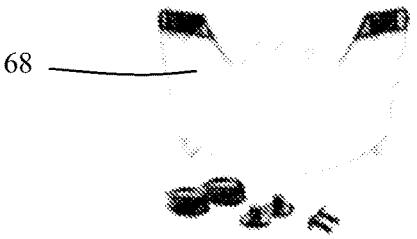
Fig. 11

Fig. 14
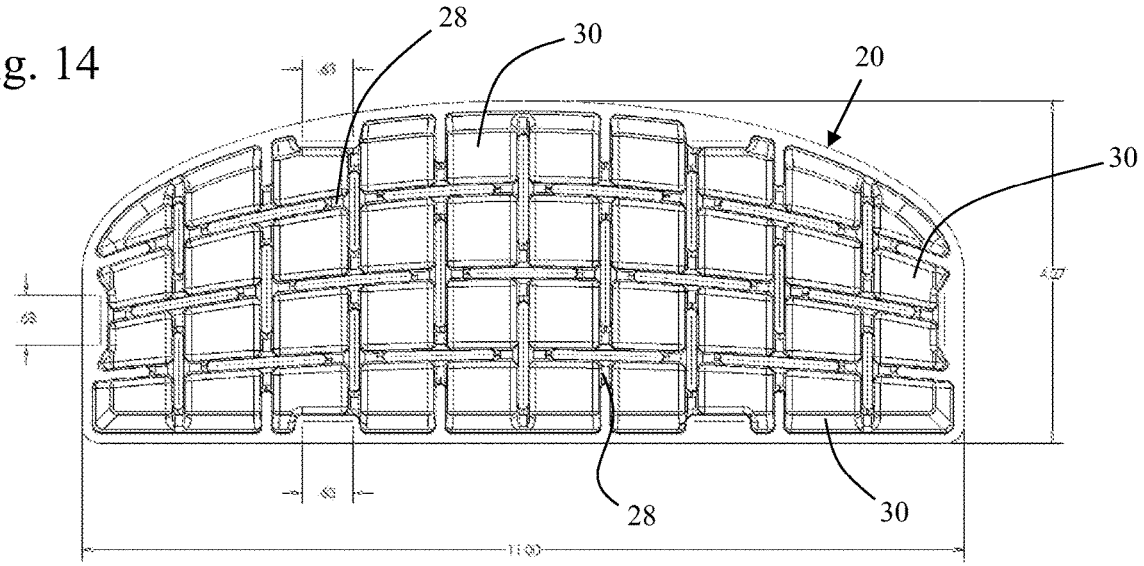
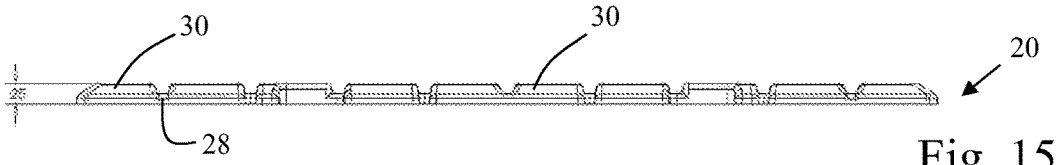
Fig. 15
Fig. 16
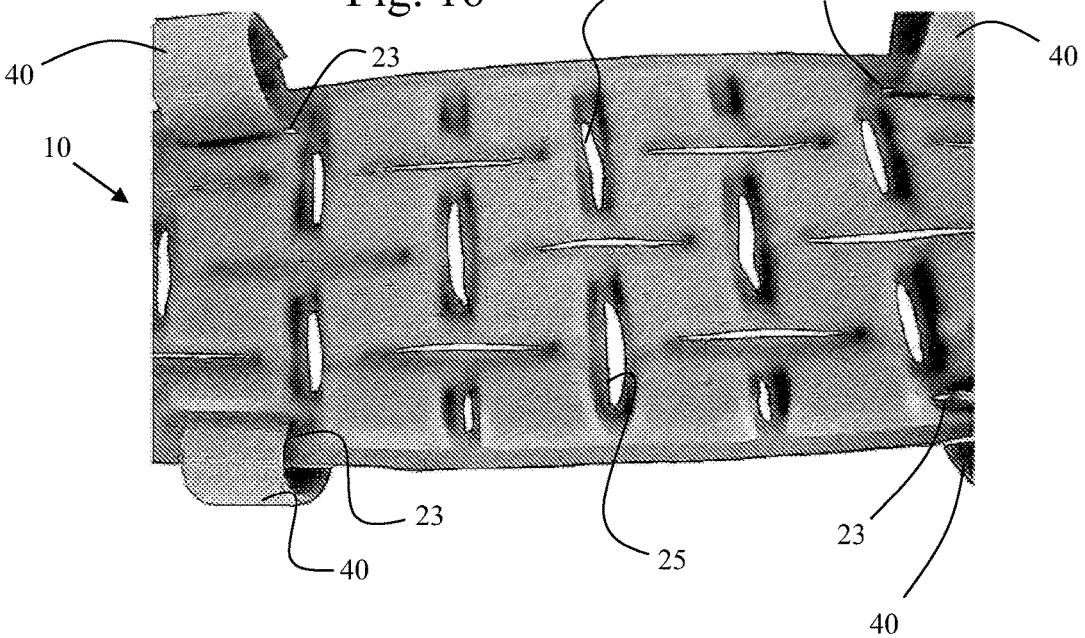

PADDED FACEMASK SHIELD

CROSS-REFERENCE TO RELATED APPLICATIONS

The present application claims the benefit of U.S. provisional patent application 63/008,179 filed Apr. 10, 2020, the disclosure of which is hereby expressly incorporated by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO A SEQUENCE LISTING

Not applicable.

STATEMENT REGARDING PRIOR DISCLOSURES BY THE INVENTOR OR A JOINT INVENTOR

Not applicable.

BACKGROUND OF THE INVENTION

The present disclosure relates to a helmet facemask shield and, more particularly, to a padded facemask shield for a helmet having a facemask.

Current helmet technology that is designed to reduce and or absorb the lateral and rotational collision forces that can contribute to head and neck injuries, offers no solution for impact sustained directly to a facemask of the helmet. The facemask cannot cushion the head or neck from the strong forces that result from collisions directly to a player's facemask. Such collisions may be the result of facemask-to-facemask, facemask-to-helmet, facemask-to-player body parts, facemask-to-ground, and or facemask to other sport specific objects that are used to play the game (e.g. football, baseball, lacrosse ball, hockey puck). Throughout any given practice, facemask collisions can repeatedly occur and may impact all player positions. Additionally, a player's facemask may be inadvertently grabbed by another player which may also lead to severe neck injury by suddenly twisting or jerking the player's head. Hand injuries may also occur due to inadvertent hand collisions with another player's facemask.

Prior products have attempted to solve one or more of these issues using collapsible hinges, springs, or absorption clips that attach directly to the helmet. Adding multiple springs, hinges, and/or clips with shock inserts is complex, costly, may not protect the player uniformly from collisions impacting different side angles and locations of the facemask, and may not function properly if the player is wearing a standard eye shield visor. Such additions may also be considered an alteration to the helmet by the helmet manufacturer, thereby voiding warranty and performance representations. Additionally, these parts may present safety risks to the player as the parts may break upon impact. These products may also vary in design and cost depending upon the type of helmet the player is wearing, thereby eliminating the consumer affordability often associated with a "one size fits all" solution.

Thus, there is a need for an easy to use and affordable device that can adequately and securely cover the facemask, cushion collisions to the facemask, reduce the potential for neck injuries that may occur as a result of players grabbing and turning an unprotected facemask, and reduce hand injuries that may occur due to a player inadvertently striking the unprotected facemask of another player. Additionally, with the increased threat of airborne viruses, there is also a need for an antimicrobial device that may be able to filter microbes from the air that can spread illness or allergies.

BRIEF SUMMARY OF THE INVENTION

The present disclosure provides a releasably attachable padded facemask shield that may mitigate linear and rotational forces by providing protective, shock-absorbing padding that is a lightweight, water-resistant, and breathable material that can accommodate repeated impact and shock absorption while providing a smooth resilient exterior or exposed, surface. The padded facemask shield includes a plurality of shock absorbing and force deflecting features utilizing, in one configuration, a flexible frame that locates protective pads with hinge-like flexibility, allowing multiple axes of rotation and an adjustable fit for a wide variety of facemask styles. Pads can be formed of a urethane-based, rate-dependent non-Newtonian foam that hardens on impact. After the moment of impact, the pad(s) return to their original state. Stretchable or deformable openings in the elastic frame intermediate at least some of the pads can contribute to the conformability of the facemask shield as well as provide airflow throughout the facemask shield to minimize any breathing restriction to the player. That is, at least one of the frame and the at least first resilient pad is sufficiently porous to pass air.

Along with the pads absorbing at least a portion of the impact from collisions, the smooth surface of the attachable padded facemask shield helps deflect forces from objects that strike the facemask by causing the forces to become non-tangential and thereby glance across the surface of the padded facemask shield. In addition, the padded facemask shield is sized to substantially cover the exposed surface area of a standard facemask, thereby preventing other players from grabbing or striking the bars of the facemask. The padded facemask shield can fit most standard facemasks by stretching the padded facemask shield in any direction and/or adjusting connecting straps.

Configurations of the present padded facemask shield provide a single standardized device that can be operatively engaged with a plurality of different facemask designs. The padded facemask shield may be lightweight, weather-resistant, extremely durable, and stretchable and/or adjustable. The padded facemask shield is configured to minimize visual or breathing restrictions to the player. That is, at least one of the frame and the at least first resilient pad is sufficiently porous to pass air.

In one configuration, the present disclosure provides a padded facemask shield assembly for a protective helmet having a facemask, the facemask having an inboard surface and an outboard surface, the padded facemask shield including a frame, such as in one configuration an elastic frame; at least a first resilient pad connected to or carried by the frame; and a coupler connected to at least one of the frame and the pad. The coupler is configured to releasably engage at least one of the facemask and the helmet and conform the frame to the helmet along the outboard surface of the facemask, and in further configurations engage the facemask shield with the facemask.

An alternative configuration provides a shock-absorbing padded facemask shield assembly for a protective helmet having a facemask, the facemask having an inboard surface and an outboard surface, the shock-absorbing padded facemask shield assembly having a frame, at least a first resilient pad connected to the frame; and a coupler connected to at least one of the frame and the first resilient pad, the coupler configured to releasably engage at least one of the protective helmet and the facemask and locate the frame and the at least first resilient pad on the outboard surface of the facemask.

In a further configuration, the present disclosure provides a padded facemask shield assembly for a protective helmet having a facemask, the facemask having a plurality of spaced bars, wherein the padded facemask shield assembly includes a first main body having a front surface and a rear surface, the rear surface configured to contact the facemask and overlie at least two spaced bars; pads disposed between at least a portion of the front surface and the rear surface; and a coupler configured to releasably engage the facemask shield with the facemask and retain the main body relative to the spaced bars. The rear surface of the padded facemask shield can contain a pocket for receiving an antimicrobial air filter which may capture and stop microbes coming into contact with the padded facemask shield thus reducing the opportunities to spread illness or allergies.

An additional configuration includes a padded facemask shield assembly for a protective helmet having a facemask, the facemask having a plurality of spaced bars, the spaced bars having an outboard surface and an inboard surface, the padded facemask shield assembly having a main body having a front surface and a rear surface, the rear surface configured to contact the outboard surface of the facemask and overlie at least two spaced bars, the main body having at least one pad, and a coupler connected to the main body, the coupler configured to releasably engage at least one of the protective helmet and the facemask and retain the main body on the outboard surface of the spaced bars.

The following will describe embodiments of the present disclosure, but it should be appreciated that the present disclosure is not limited to the described embodiments and various modifications of the invention are possible without departing from the basic principles. The scope of the present disclosure is therefore to be determined solely by the appended claims.

BRIEF DESCRIPTION OF THE SEVERAL VIEWS OF THE DRAWING(S)

FIG. 4 is a front elevational view of a representative chin strap.

FIGS. 5-10 are various configurations of commercially available facemasks.

FIG. 11 is a front elevational view of a visor assembly for a helmet.

FIG. 14 is a front perspective view of the frame and pads of the first configuration of the padded facemask shield of FIG. 12

FIG. 15 is a side elevational view of the frame and pads of the first configuration of the padded facemask shield of FIG. 14

FIG. 16 is an enlarged front perspective view of the first configuration of the padded facemask shield of FIG. 12.

DETAILED DESCRIPTION OF THE INVENTION

Figure 1:
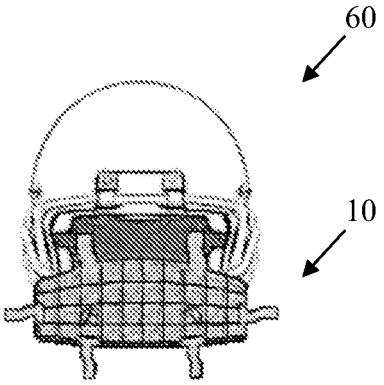
FIG. 1 is a front elevational view of a first configuration of the present padded facemask shield.
Figure 2:
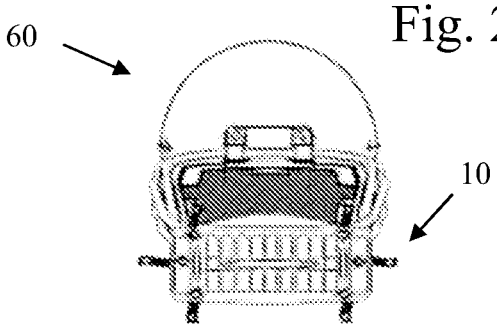
FIG. 2 is a front elevational view of a second configuration of the present padded facemask shield.

Referring to FIGS. 1 and 2, the present disclosure provides a first configuration and a second configuration of a padded facemask shield 10 configured to releasably engage a helmet 60.

Figure 3:
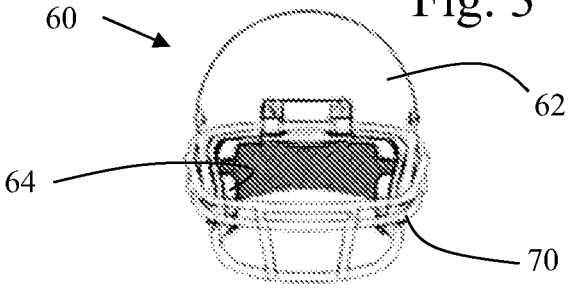
FIG. 3 is a front elevational view of a representative helmet.
Figure 12:
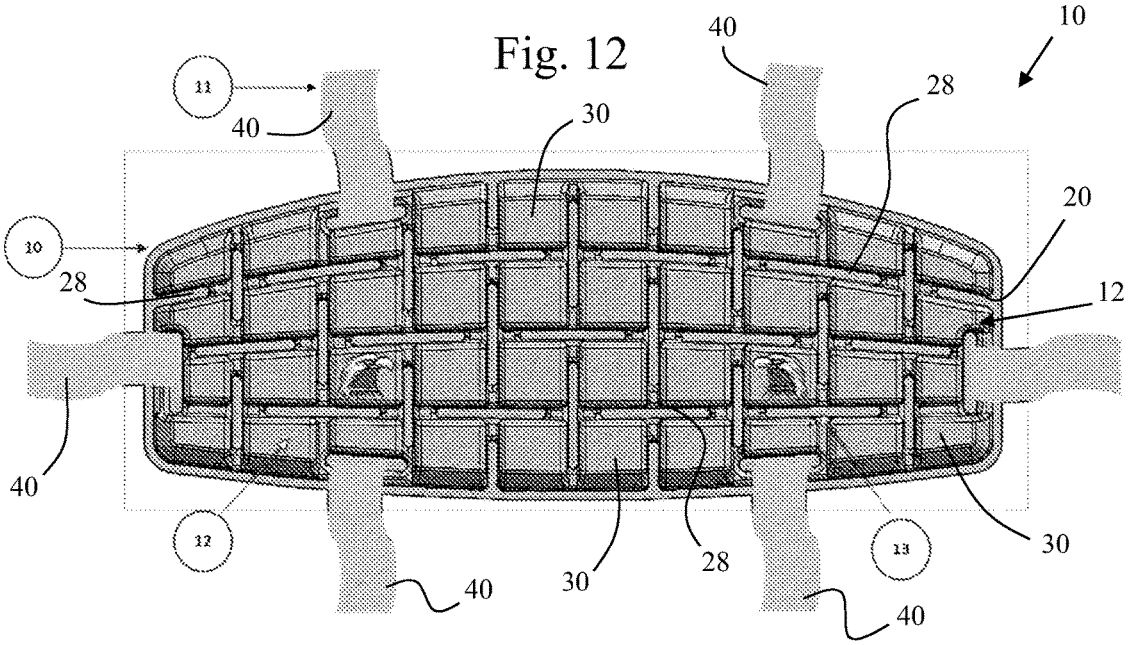
FIG. 12 is a front perspective view of the first configuration of the padded facemask shield.

As seen in FIG. 3, the helmet 60 encompasses protective headgear, and particularly a helmet having a facemask 70, such as an American football helmet. Although for purposes of description, the facemask 70 is set forth in conjunction with an American football helmet, it is understood the helmet 60 can be any sports helmet or other protective head gear having at least a partial facemask.

The American football configuration of the helmet 60 includes a shell 62, a shell padding 64, the facemask 70, and a chinstrap 66 (shown for clarity separately in FIG. 4).

The shell 62 is a hard, rigid protective cover that absorbs and distributes impact. Typically, the shell 62 is sized or configured to protect at least a portion of a player's head. The shell 62 has sufficient strength to resist penetration during intended use as well as provide an anchor for the shell padding 64, the facemask 70 and the chin strap 66. Typical shells 62 are formed of acrylonitrile-butadiene-styrene (ABS) thermoplastic resin, polycarbonate or polycarbonate alloys.

The shell padding 64 is affixed to an inside surface of the shell 62 and defines an interface between the helmet 60 and the head of the player. In select configurations, the shell padding 64 is releasably engaged to the shell 62 to provide for customization of fit or replacement of the shell padding.

Referring to FIG. 4, the chinstrap 66 functions to keep the helmet 60 in the proper location during use. There are generally two main styles of chinstraps: a four-point chinstrap and a two-point chinstraps. The chinstrap 66 can include padding 67 such as in the area of the chin of the player.

The American configuration of the facemask 70 has a plurality of intersecting bars 72 rigidly affixed to each other and connected to the shell 62. The facemask 70 has an inboard surface 73 exposed to the player wearing the helmet 60 and an outboard surface 75 exposed to an opposing player. Representative facemasks are shown in FIGS. 5-10.

The facemask 70 can have any of a variety of configurations, such as but not limited to a closed cage or an open cage. The closed cage typically includes a vertical bar as well as a reduced vertical gap between horizontal bars 78 in the field of vision. The open cage facemask 70 has horizontal bars 78 at nose level and below, but is open around the eye area to maximize the field of vision of the player. Further, the facemask 70 can have a curvature such that a center of the facemask 70 is from 0.25 inches to 12 inches to 16 inches or more from terminal ends of the facemask, depending at least in part on the size of the helmet and hence facemask 70.

It is further contemplated that the facemask 70 may curve about multiple axis. That is, the curvature of the facemask 70 may extend about a single axis or a plurality of axes.

Although the shells 62 are designed to mitigate the amount of force that is distributed to a player's head and neck upon impact, the facemask 70, is usually constructed of coated metal such as steel, offers no absorption to the forces directly impacting it. Given the rigidity of the facemask 70, the facemask can tend to transmit an impact force to the head and neck region of the player wearing the helmet 60.

Referring to FIG. 11, it is further contemplated the helmet 60 can include a visor 68 in conjunction with the facemask 70. The visor 68 can be operatively connected to at least one of the shell 62 and the facemask 70.

Referring to FIGS. 12, 13 and 16-18, the padded facemask shield 10 includes a frame 20, at least one resilient pad 30 and at least one coupler 40. The padded facemask shield 10 has an outer surface 12 exposed to opposing players and an inner surface 14 exposed towards a face of the player wearing the helmet 60. The padded facemask shield 10 is configured to releasably engage the facemask 70 and particularly be located on the outboard surface 75 of the facemask as shown in FIGS. 1 and 2.

The padded facemask shield 10 is configured to conform to the outboard surface 75 of the facemask 70. In one embodiment, the padded facemask shield 10 is sufficiently flexible to conform to the outboard surface 75 of the facemask 70. It is contemplated the padded facemask shield 10 can be formed to have a curvature corresponding to the curvature of the outboard surface 75 of the facemask 70. Alternatively, as set forth herein, embodiments of the padded facemask shield 10 are configured as sufficiently flexible to conform to the outboard surface 75 of the facemask 70, thereby allowing a single padded facemask shield to be operably engaged with any of a plurality of different facemasks 70.

The outer surface 12 of the padded facemask shield 10 being exposed to opposing players has a surface configured to minimizing engaging with the opposing player, either the person or their equipment. The outer surface 12 is sufficiently smooth to reduce engagement with the opposing players. In select configurations, the outer surface 12 can be planar. However, it may be advantageous for the padded facemask shield 10 to have an overall curvature, while maintaining the smooth outside surface.

In one configuration, the frame 20 is constructed of a flexible fabric. In a further configuration, the frame 20 is formed of an elastic material can stretch easily and quickly return to its original shape, thus providing an elastic frame. For example, the frame 20 can be formed of a flexible and resilient fabric, which can stretch isotopically. The frame 20 retains and locates the resilient pads 30, relative to each other and relative to the frame. The frame 20 is constructed to be sufficiently flexible to conform to a curvature of the facemask 70, and particularly the outboard surface 75 of the facemask.

In FIGS. 12-18, the frame 20 is shown as an elastic frame retaining the pads 30, such that the frame provides a hinge-like flexibility, allowing multiple independent degrees of rotation for positioning of the pads and hence the facemask shield 10 to provide an accommodating fit to the respective facemask 70. In such configuration, the pads 30 are sized to accommodate the imparted curvature of the frame 20, wherein a given individual pad is not required to substantially bend to allow the facemask shield as a whole to conform to extended dimensions of the facemask 70. There is a line 28 of flexure or bending between adjacent pads 30 which allows relatively planar individual pads to rotate relative to each other and thereby allow the facemask shield 10 to conform to an underlying curvature of the facemask 70. Alternatively, it is contemplated that the pads 30 can be formed to exhibit a natural state curvature, wherein the cumulative curvature of the pads 30 conforms to the outboard surface 75 of the facemask 70. The pads 30 can be separate, individual pads interconnected by portions of the frame 20, or the pads can be defined by localized thinning of the pad material which defines the respectively pads, wherein the localized thinning defines the line of flexure or bending 28 between adjacent pads.

The pads 30 can be formed of a polymer composition, such as a urethane based, rate dependent non-Newtonian foam that hardens on impact. In one configuration, the pads are formed of SMARTFLEX® stretch technology by G-Form, LLC of Rhode Island, wherein such pads can be molded to a Lycra Spandex fabric of the Lycra Company and can provide an auxetic stretch. Auxetics are structures or materials that have a negative Poisson's ratio. When stretched, the materials, such as the pads 30, become thicker perpendicular to the applied force. As a rate dependent material, after the moment of impact and tie removal of the impact force, the pads 30 return to their original state. In one configuration, the pads 30 are a cellular material, such as a foam material, and in some configurations a low density foam. Examples of suitable low density foams include polyester and polyether polyurethane foams. In some instances, it may be desirable for the pad 30 to be capable of providing impact resistance. In such instances, various types of impact absorbing materials have been found suitable, particularly energy absorbing or rate dependent materials, including foams. For such applications, it can be desirable for the pad 30 to be formed of a foam having a density ranging from about 5 to about 35 pounds per cubic foot (pcf), more particularly from about 10 to about 30 pcf, and more particularly still from about 15 to about 25 pcf. In one configuration, suitable rate dependent foams are available from Rogers Corporation under the brand names PORON® and PORON XRD®, which are open cell, microcellular polyurethane foams. The pads 30 can also be formed of foams in accordance with U.S. Pat. Nos. 9,615,611 and 9,770,642 both of which are hereby expressly incorporated by reference. Further, D3O® materials from Design Blue Ltd, UK, such as set foams (SF); set elastomers (SE); formable foams (FF); formable elastomers (FE)—as well as impact additives (iA) can be employed in the pads 30. In a further configuration, the pad 30 can be formed of a commercially available shock absorbing gel, such as SHOCKtec Gel™ a dry viscoelastic polymer with a polyurethane film and a polyurethane foam and viscoelastic polymer appearance, or SHOCKtec® Air2Gel an air-frothed viscoelastic dry polymer having a dry viscoelastic polymer contained within a polyurethane film and a polyurethane foam, each by SHOCKtec of Mooresville, NC 28117.

As set forth above, the pad 30 can be formed of a rate dependent urethane based foam which hardens (increases resistance to shear) on impact and returns to a relatively more flexible state upon removal of the impact force. The pad 30 can be of a rate-sensitive, soft, flexible material, with a high shock absorbing properties, wherein in a pre-impact state the molecules of the material flow freely, allowing the material to be soft and flexible, but on impact, the molecules effectively lock together to dissipate impact energy and reduce transmitted force. In one configuration, the foam of the pad 30 is a thermosetting polyurethane foam. In one configuration, the pads 30 are molded into the frame 20.

Alternatively, the pads 30 can be, as manufactured, encapsulated in a protective fabric covering, which in turn is incorporated into the frame 20, or the covering and pads are configured to form the frame. For example, a fabric of elastance fiber, such as LYCRA® fiber by DuPont Company, can be molded over the pads 30, such as urethane foam pads, to provide auxetic stretch which may provide configuration and fit of the facemask shield 10 to the rigid facemask 70. That is, frame 20 or the pads 30 can incorporate an auxetic textile which possess a negative Poisson's ratio. Thus, in contrast to conventional textile materials if they are stretched in longitudinal direction, the auxetic textile provides a marginal expansion resulting in transversal direction.

It is contemplated that one configuration of the facemask shield 10 can be constructed as a main body having an integral frame 20 and pads 30, wherein the frame, such as the fabric the frame is bonded to, or molded to the pads, to preclude non-destructive separation. That is, depending on the construction of the frame 20 and the pads 30, the function of the frame can be incorporated into the pads, wherein the pads include interconnecting webs or a local thinning of the pads or have an interstitial space between the pads, which provides the requisite flexing, bending, or rotation of the facemask shield 10 to conform to the outboard surface 75 of the facemask 70, while providing secure interconnection to the couplers 40. Thus, the recitation of the frame 20 and the pads 30 is intended to encompass a main body having a pad structure and integrated the frame 20, wherein the pad structure includes preferential lines of flexing, bending or rotation 28 to allow for conforming to the outboard surface 75 of the facemask 70. That is, the pads 30 can be integrated into the frame 20 or the frame can be integrated into the pads, wherein it is understood both configurations are encompassed by the presently recited frame 20 and the pads 30.

The padded facemask shield 10 can include from 1 to up to 40 or more pads 30. In one configuration, 12 pads 30 are located along the padded facemask shield 10 in a corresponding curvature to the standard facemask 70. The individual pads 30 can have any of a variety of peripheries, wherein upon interconnection of the pads by the frame 20, the pads 30 overlie a majority of the outboard surface 75 of the facemask 70. Thus, the pads 30 can have curvilinear peripheries, rectilinear or faceted peripheries. The frame 20 can define a constant spacing between the pads or can provide for different spacing of the respective pads, as at least partly dictated by elongation properties of the frame and the intended operating size. Further, the periphery and size of each pad 30 can be the same across all the pads. Alternatively, the location of the pad 30 relative to the frame 20 can dictate the shape and periphery of the pad, as well as a local spacing between adjacent pads. That is, in some configurations a multitude of individual pads 30 can be used or a smaller number of larger individual pads, such as 3 to 6 pads, can be employed.

Further, the pads 30 can have a thickness defined by a continuous layer of the material forming the pad, wherein both the inner surface 14 and the outer surface 12 are substantially continuous. Alternatively, there can be a plurality of pads 30 forming spaced individual cushion segment projections, wherein the projections extend at the inside surface defining the thickness of the padded facemask shield 10, while the outer surface 12 remains continuous. Conversely, as seen in FIG. 15, the outer surface 12 of the facemask shield 10 can be defined by a plurality of projections of the pads 30.

It is also contemplated that the padded facemask shield 10 can have a varying thickness along a width and/or a height of the facemask shield. That is, the pads 30 can include foam layer or foam projections that vary across a width and/or height of the padded facemask shield 10. In further configurations, the padded facemask shield 10 can have constant thickness across the width and/or the height, as in FIG. 15.

The pads 30 can be formed by cutting the foam to a predetermined thickness corresponding to the intended final thickness of the padded facemask shield 10 and a predetermined footprint or periphery, wherein a plurality of projections can be employed throughout the padded facemask shield 10. As set forth above, a working thickness of ⅛ inch to ¼ inch is believed satisfactory for the pads 30. Alternatively, the pads 30 and the frame 20 can be continuous uniform thickness, wherein the pads are subsequently compression molded to define the lines of decreased thickness forming the flexing, bending or rotation lines 28 between adjacent projections. That is, some areas of the pads 30 can be more compressed than other areas of the pads so as to define the web 28 between the projections.

Thus, the thickness of the pad 30 is at least partially determined by the material of the pad, such as the foam, as it is cut to a pre-determined thickness which is at least partially determined by the required finished thickness of the molded parts. In one configuration, once the foam of the pad 30 has been cut to thickness, the fabric of the frame 20 is laminated to the foam using heat and pressure to activate a hot melt film which mechanically bonds the fabric to the foam. The material composite is then cut into a blanked size for compression molding, thus providing the frame 20 and the pads 30.

Referring to FIG. 16, the frame 20 can further include plurality of apertures or openings 23 for engaging the coupler 40. In addition, the frame 20 can include a plurality of apertures 25 intermediate the pads 30, wherein the apertures 25 are configured to be opened upon any stretching of the frame 20 thereby forming passageways for air flow. The apertures 25 can also allow for increased conforming of the facemask shield 10 to the curvature of the facemask 70. The apertures or cutouts 25 thus can provide additional air flow to the breathable material as well as provide enhanced flexibility to the facemask shield 10 The apertures 23 and/or 25 can include reinforcing stitching or additional material about the respective periphery so as to resist tearing. Thus, the frame 20 and the at least one resilient pad define a preferential air passageway 23 and/or 25. In one configuration, the frame 20 can be formed of an impermeable breathable membrane, known in the art and widely used for the production of garments and other clothing, such as in U.S. Pat. No. 10,736,366, herein expressly incorporated by reference. The frame 20 is thus impermeable in the sense that the frame resists the ingress of liquid water and wind, whilst at the same time being water-vapor-permeable, such that moisture (perspiration/sweat) given off by the player is able to pass through the material of the frame. This avoids a buildup of moisture within the padded facemask shield. Many such types of impermeable breathable fabrics are known in the art and often include moisture vapor permeable polyurethanes and expanded polytetrafluoroethylene membranes (ePTFE).

The couplers 40 can be any of a variety of configurations including, but not limited to straps, snaps, stitching or threading. The couplers 40 provide for the interlocking of the padded facemask shield 10 to the helmet 60 and particularly to the facemask 70. In FIG. 16, elastic, hook and loop fasteners can function as the couplers 40 inserted through the reinforced openings inserted along the apertures 23 of the padded facemask shield 10 and do not require any sewing or hardware (snaps, buttons) that could break upon contact and become a safety risk to the player.

The couplers 40 can be configured to provide for operable engagement of the padded facemask shield 10 with the helmet 60 and particularly the facemask 70. It is further contemplated the couplers 40 can engage the shell 62 in conjunction with the facemask 70 to retain the padded facemask shield 10. Alternatively, it is contemplated the couplers 40 can engage the facemask 70 to retain the padded facemask shield 10.

Figure 13:
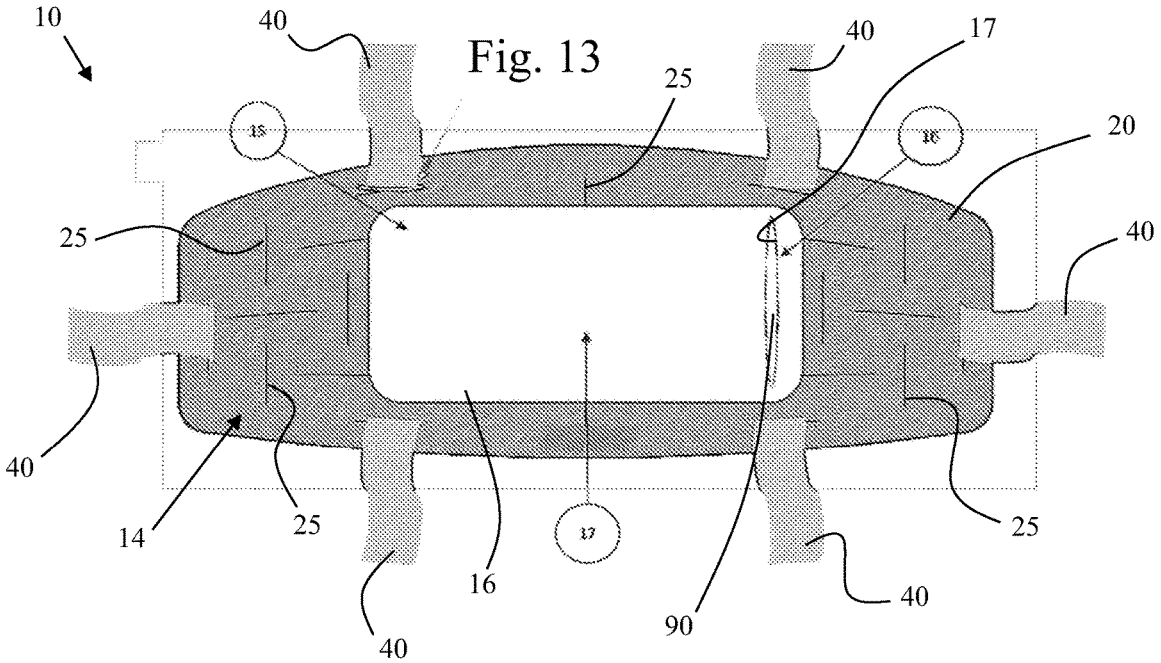
FIG. 13 is a rear perspective view of the first configuration of the padded facemask shield.
Figure 17:
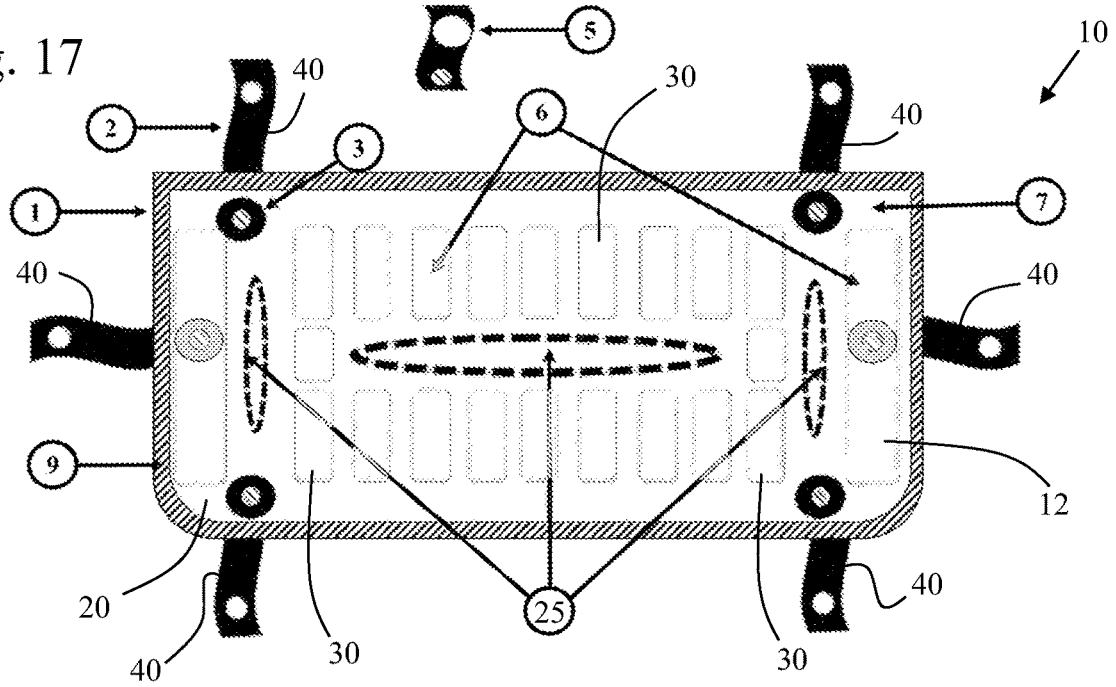
FIG. 17 is a front perspective view of the second configuration of the padded facemask shield.
Figure 18:
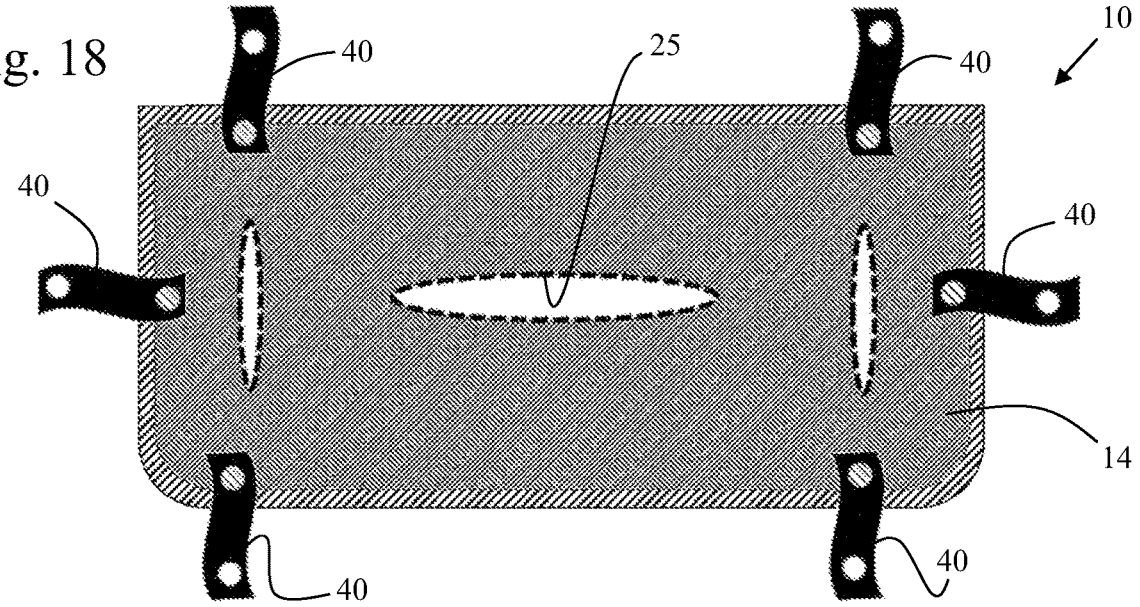
FIG. 18 is a rear perspective view of the second configuration of the padded facemask shield of FIG. 17.

In select configurations, such as FIG. 13, the inner surface 14 of the facemask shield 10 can include a filter pocket 16, wherein the filter pocket is configured to receive a filter 90. The filter pocket 16 can be formed of an elastic material to define an elastic pocket. Alternatively, the filter pocket 16 can include flaps or folds for releasably retaining the filter 90. The filter pocket 16 can be integrally formed with the frame 20 or can be releasably attached to the frame, such as for example by hook and loop fasteners.

The filter 90 is selected to filter passing air, and in one configuration provides an antimicrobial filter of the air.

Thus, the padded facemask shield 10 can include the filter pocket or sleeve 16 attached to the inner surface 14 of the padded facemask shield with a breath-through elastic material that will contain the filter 90, such as an antimicrobial filter which may protect the player against airborne viruses and allergy related particles. The frame 20 and at least one resilient pad 30 define the preferential air passageway 23 and/or 25, wherein the filter pocket 16 is configured to retain the replaceable air filter 90, wherein air passing through the preferential passageway passes through the air filter. The filter pocket 16 can be connected to frame 20 by stitching along the outer edges of the packet, as shown in FIG. 16, or by bonding to provide a seamless connection. The filter pocket 16 can be formed of commercially available Pinecrest Fabrics-80% Polyester 20% Spandex/270 GSM/Wicking interlock/4-way stretch. It is contemplated the filter pocket 16 can include an antimicrobial finish. The filter pocket 16 has an opening 17 configured to provide for the insertion of the filter 90, such as an antimicrobial filter. The replaceable filter 90 can be selected to provide any of a variety of filtration capabilities, such as but not limited to ASTM Level 1, 2 or 3 as well as N95 or better.

The padded facemask shield 10 having the frame 20 configured as an elastic frame provides a number of advantages including being sufficiently stretchable to operably attach to virtually any size facemask 70 by virtue of the couplers 40 positioned around the perimeter of the frame and pads 30. A player can attach the padded facemask shield 10 to the lower portion (below eye level) of an existing facemask 70 on any helmet 60. The padded facemask shield 10 is readily attachable as the padded facemask shield can stretch in any direction to cover the surface area of the bars of the facemask 70. It is contemplated that the overall shape and size of the padded facemask shield 10 can be adjusted to fit other helmets 60 containing facemasks 70.

Although the facemask shield 10 can have a variety of dimensions, at least partly dictated by the intended use, the facemask shield can have a width between 8 inches to 14 inches and a height between 4 inches to 6 inches, wherein a satisfactory size has been found to be a width between 10¾ inches and 11¾ inches with a height between 4¾ inches and 5¾ inches, with an exemplary width of 11 inches and height of 4.27 inches. The padded facemask shield 10 has a thickness, or depth, at least partly determined by the selected cushion material and the intended use. Satisfactory thickness for present materials has been found to ⅛ inches for the frame 20, and ¼ inch for the pads 30.

The padded facemask shield 10 may also reduce the occurrence of another player grabbing the facemask 70 thereby, contributing to serious neck injury. That is, the padded facemask shield 10 overlies a majority of the area of the facemask 70, so as to reduce the ability of another player to grab the bars of the facemask. In one configuration, the padded facemask shield 10 is sized to overlie at least 10% of the area of the facemask 70, in further configurations overlies at least 25%, and in further configurations overlies at least 50%, and in additional configurations, at least 75% and in some configurations over 80% of the area encompassed by the facemask. The padded facemask shield 10 can help reduce injuries to a player's wrist and hand due to striking another player's facemask 70. It is contemplated the padded facemask shield 10 may be worn during practice and games, thereby providing uninterrupted protection to the player.

As set forth above, the padded facemask shield 10 is constructed of materials that are washable, lightweight, and easy to breathe through, and provides antimicrobial resistance. In the configurations employing the pocket 16, the filter 90 can be retained in the pocket, so that the player can choose to breathe through the antimicrobial air filter.

It is further theorized that the padded facemask shield 10 may serve as a deterrent to the long-term damage of sub-concussive hits. That is, recent literature and research on the topic of sub-concussive hits suggests that an increase in delta waves in the brain (caused by multiple sub concussive impacts) over time may correspond to possible long-term damage to brain function. To the extent the present facemask shield 10 absorbs at least some energy of an impact to the shield (and hence helmet 60), such energy will not be transferred to the player.

This disclosure has been described in detail with particular reference to an embodiment, but it will be understood that variations and modifications can be effected within the spirit and scope of the disclosure. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A shock-absorbing padded facemask shield assembly for a protective helmet having a facemask, the shock-absorbing padded facemask shield assembly comprising:

(a) a facemask having an inboard surface and an outboard surface;

(b) a frame including an inner surface and an outer surface, wherein the inner surface of the frame is a continuous layer;

(c) a padded structure connected to the outer surface of the frame, wherein the padded structure is configured to conform to a curvature of the outboard surface of the facemask, wherein the padded structure includes a plurality of padded projections, wherein the plurality of padded projections extends away from the inner surface of the frame; and (d) a coupler connected to at least one of the frame and the padded structure, the coupler configured to releasably engage the facemask and locate the inner surface of the frame on the outboard surface of the facemask, and wherein both the inner surface of the frame and the padded structure cover a majority of a surface area of the outboard surface of the facemask.

2. The shock-absorbing padded facemask shield assembly of claim 1, wherein the frame stretches in multiple directions.

3. The shock-absorbing padded facemask shield assembly of claim 1, wherein at least one of the frame and the padded structure is configured to pass.

4. The shock-absorbing padded facemask shield assembly of claim 1, wherein the frame comprises a breathable, elastic material.

5. The shock-absorbing padded facemask shield assembly of claim 1, wherein the coupler is a strap and is configured to engage the facemask.

6. The shock-absorbing padded facemask shield assembly of claim 1, wherein the padded structure includes at least one of a foam, a gel, and a molded polymer.

7. The shock-absorbing padded facemask shield assembly of claim 1, wherein the coupler is a hook and loop fastener.

8. The shock-absorbing padded facemask shield assembly of claim 1, wherein the frame is elastic.

9. The shock-absorbing padded facemask shield assembly of claim 1, wherein the frame is flexible.

10. The shock-absorbing padded facemask shield assembly of claim 1, wherein, both the inner surface of the frame and the padded structure extend laterally and vertically across at least 75% of the surface area of the outboard surface of the facemask.

11. The shock-absorbing padded facemask shield assembly of claim 1, wherein the padded structure includes a plurality of flexing lines, wherein each flexing line of the plurality of flexing lines separates at least two padded projections of the plurality of padded projections, wherein the plurality of flexing lines enables the padded structure to conform to the curvature of the facemask.

12. A padded facemask shield assembly for a protective helmet having a facemask, the padded facemask shield assembly comprising:

(a) a facemask having at least two spaced bars, the at least two spaced bars having an outboard surface and an inboard surface;

(b) a main body having a front surface and a rear surface, the rear surface configured to contact the outboard surface of the facemask and overlie the at least two spaced bars, wherein the rear surface is a continuous layer, wherein the main body further includes a padded structure, wherein the padded structure includes a plurality of pads; and (c) a coupler connected to the main body, the coupler configured to releasably engage the facemask and retain the main body on the outboard surface of the spaced bars, wherein the main body is configured to conform to a curvature of the at least two spaced bars.

13. The padded facemask shield assembly of claim 12, wherein the padded structure includes at least one of a foam, a gel, and a molded polymer.

14. The padded facemask shield assembly of claim 12, wherein the main body includes an elastic frame connected to the padded structure.

15. The padded facemask shield assembly of claim 12, wherein the plurality of pads is disposed between at least a portion of the front surface and the rear surface of the main body.

16. The padded facemask shield assembly of claim 12, wherein the main body is a fabric.

17. The padded facemask shield assembly of claim 12, wherein the main body is flexible.

18. The padded facemask shield assembly of claim 12, wherein the plurality of pads extends away from the rear surface of the main body, wherein the main body and the padded structure cover a majority of a surface area of the outboard surface of the at least two spaced bars.

19. The padded facemask shield assembly of claim 12, wherein the padded structure includes a plurality of flexure lines, wherein each flexure line of the plurality of flexure lines separates at least two pads of the plurality of pads, wherein, via the plurality of flexure lines, the main body is configured to conform to the configured of the at least two spaced bars.

* * * * *